United States Patent [19]

Takada et al.

[11] Patent Number: 4,776,715

[45] Date of Patent: Oct. 11, 1988

[54] HEAD ROTATING MECHANISM FOR A PRINTER

[75] Inventors: Hiromi Takada, Yokohama; Toshio Shimazaki, Tokyo; Keiji Okamoto, Yokohama, all of Japan

[73] Assignee: Ricoh Company, Ltd., Tokyo, Japan

[21] Appl. No.: 89,233

[22] Filed: Aug. 25, 1987

[30] Foreign Application Priority Data

Sep. 12, 1986 [JP] Japan ..... 61-215114

[51] Int. Cl.[4] ..... B41J 3/20; B41J 19/14; B41J 3/58

[52] U.S. Cl. ..... 400/323; 400/120; 400/82

[58] Field of Search ..... 400/120, 323, 124, 82; 101/93.03

[56] References Cited

U.S. PATENT DOCUMENTS 4,195,937 4/1980 Baran ..... 400/120

FOREIGN PATENT DOCUMENTS 168204 3/1984 Japan ..... 400/124
157079 3/1984 Japan ..... 400/124
198167 11/1984 Japan ..... 101/93.05
192656 10/1985 Japan ..... 400/323
192660 10/1985 Japan ..... 400/323

*Primary Examiner*—William Pieprz
*Attorney, Agent, or Firm*—Cooper & Dunham

[57] ABSTRACT

A recording head of a current application type serial printer is provided with two independent recording electrode groups on both sides of its tip. The angle of contact of the recording head with a platen of the printer is switched between a forward printing stroke and a backward printing stroke of a carrier so that, usually, the electrode group on the right-hand side of the recording head is used during the forward printing stroke, and the electrode group on the left-hand side during the backward printing stroke.

9 Claims, 4 Drawing Sheets

HEAD ROTATING MECHANISM FOR A PRINTER

BACKGROUND OF THE INVENTION

The present invention generally relates to a serial printer of the type having a current application type printing head which is mounted on a carrier and provided with independent recording electrode groups on both sides of its tip, the carrier being movable back and forth to sequentially print out data in both directions in a paper which is wrapped around a platen. More particularly, the present invention relates to a mechanism for rotating, or swinging, such a printing head so as to switch the angle of contact of the head with the platen between a forward and a rearward stroke of the carrier.

There has already been proposed a serial printer of the type having a carrier which is movable along a platen in both of a forward stroke, i.e., usually fom the left to the right and a backward stroke, i.e., from the right to the left so as to print out data during both of its forward and backward strokes. Another serial printer heretofore proposed uses a recording material (ribbon or paper) which is provided with a conductive layer. In this kind of serial printer, the conductive layer is connected to ground via a ground electrode, and a current is selectively applied to a group of recording electrodes of a recording head which are pressed against the conductive layer. This causes the recording electrodes to heat to print out data in the paper.

However, as regards printers of the type described, no specific construction has heretofore been proposed when it comes to a head rotating mechanism for changing the angle of contact of the recording head with the platen, so that a recording electrode group mounted, usually, on the right-hand side of the tip of the head may be used during a forward stroke and a recording electrode group mounted on the left-hand side during a backward stroke.

SUMMARY OF THE INVENTION

It is, therefore, an object of the present invention to provide a head rotating mechanism for switching the angle of contact of a recording head of a current application type serial printer with a platen between a forward and a backward printing stroke of a carrier.

It is another object of the present invention to provide a head rotating mechanism for a printer.

A head rotating mechanism of the present invention is applicable to a printer in which a recording head provided with one recording electrode group at each of both sides of a tip of the recording head is mounted on a carrier and, while the carrier is sequentially driven for a forward and a backward stroke, a contact angle of the recording head with a platen is switched between the forward and backward strokes by rotating the recording head. The mechanism comprises a switching lever rotatably supporting the recording head, a switching gear having a cam portion for pivotally moving the switching lever in directions for moving the recording head toward and away from the platen, and an engaging portion for rotating the recording head based on the direction of pivotal movement of the switching lever, a bracket rotatably supporting the switching gear and switching lever and having a guide portion for guiding the rotation of the recording head, and a motor provided on the carrier together with the bracket for imparting rotation to the switching gear.

The above and other objects, features and advantages of the present invention will become more apparent from the following detailed description taken with the accompanying drawings.

DESCRIPTION OF THE PREFERRED EMBODIMENT

Figure 1:
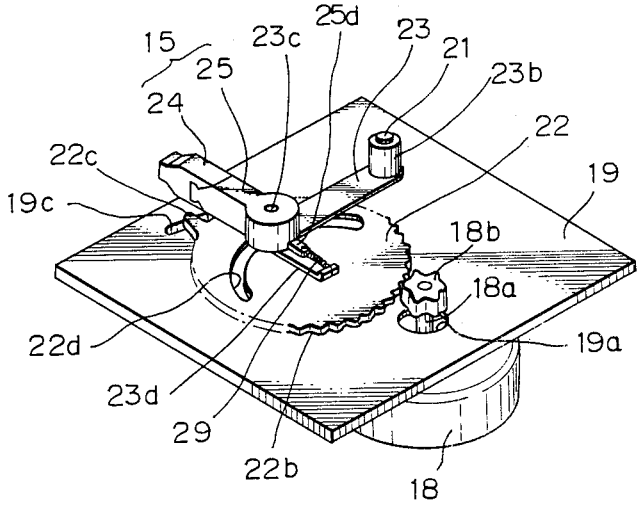
FIG. 1 is a perspective view of a head rotating mechanism embodying the present invention and which is applied to a current-application transfer type serial printer.

Referring to the drawings, a head rotating mechanism embodying the present invention is shown which is applied to a current-application transfer type serial printer. As shown, a platen 10 is supported by a right and a left side plate of the printer, as well known in the art. A carrier 11 is disposed to face and reciprocate along the platen 10, as also well known in the art. A ribbon cassette 12 is mounted on the carrier 11. A ribbon 13 which is pulled out fromt eh ribbon cassette 12 is guided by guide rollers 14 to extand along the platen 10, the guide rollers 14 being studded on the carrier 11. A recording head 15 is mounted on the carrier 11 and pressed against the platen 10 with the intermediary of the ribbon 13. While the carrier 11 is moved along the platen 10, current is adequately applied to the recording head 15 so that ink is sequentially transferred from the ribbon 13 to a paper, which is wrapped around the platen 10, so as to print out desired data in the paper. A head rotating mechanism of the present invention, generally A, is provided on the carrier 11 to angularly move the recording head 15 based on the direction of movement of the carrier 11, whereby a right and a left recording electrode groups provided on the right- and left-hand sides of the head 15, respectively, are selectively pressed against the platen 10.

Figure 2:
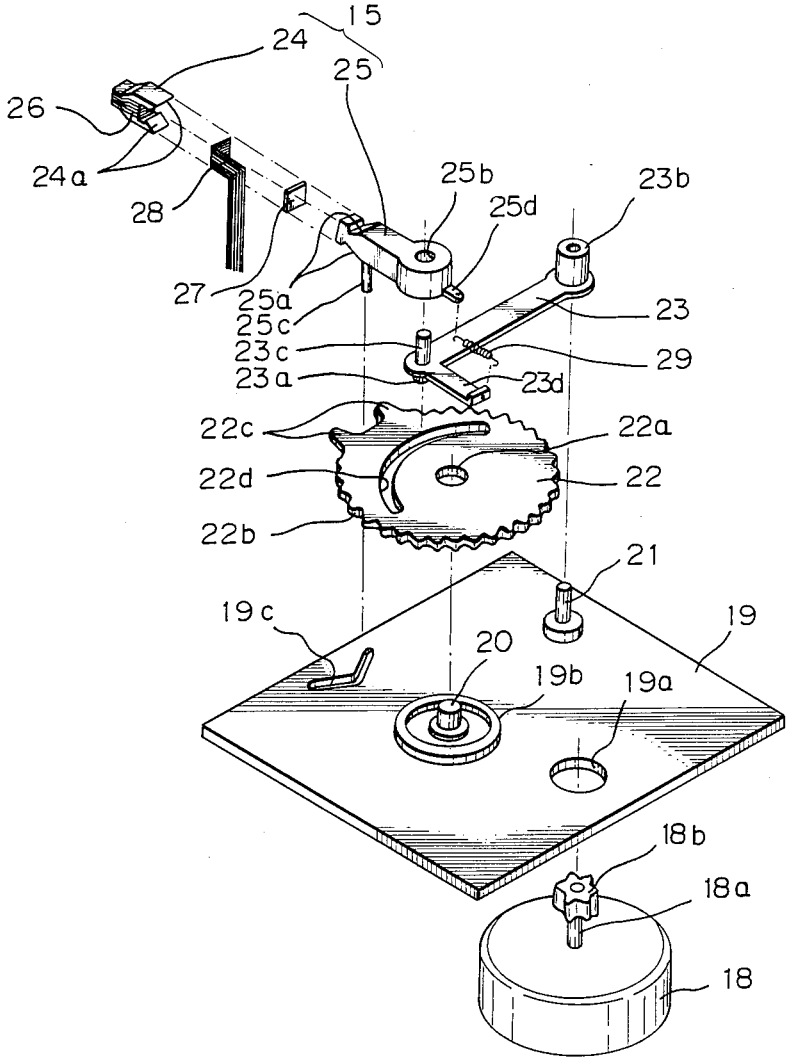
FIG. 2 is an exploded perspective view of the mechanism as shown in FIG. 1.
Figure 3:
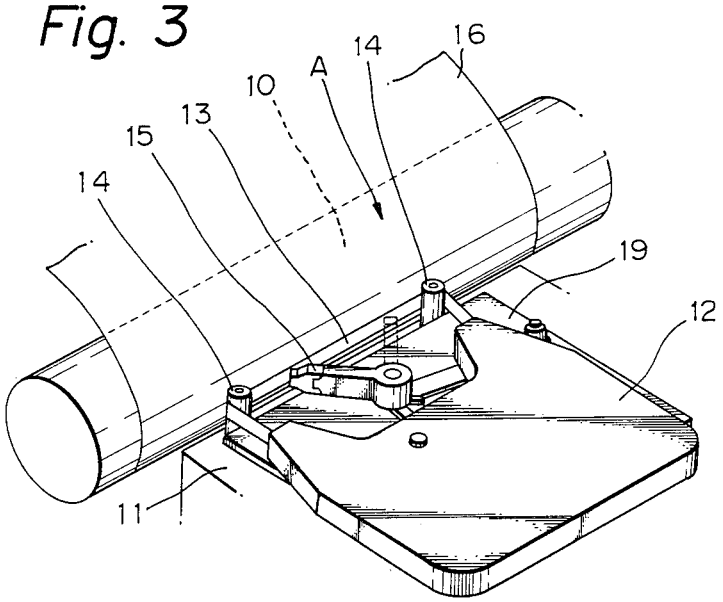
FIG. 3 is an enlarged perspective view of a carrier of the printer in which the mechanism of the present invention is installed.

As shown in FIGS. 1 and 2, the head rotating mechanism A includes a motor 18 such as a stepping motor or a DC motor, and a bracket 19 which is disposed above the motor 18. A motor gear **18*b* is rigidly mounted on an output shaft 18*a* of the motor 18. Having, for example, a generally rectangular shape, the bracket 19 is positioned flat on the carrier 11 and formed through its rear portion with a circular opening 19*a* for receiving the output shaft 18*a* of the motor 18. Two laterally spaced stepped pins 20 and 21 are studded on the bracket 19 at substantially the intermediate between the front and rear ends of the latter, the pin 20 being shorter than the pin 21. An annular projection 19*b* is provided on the bracket 19 to surround the stepped pin 20, i.e., to have the stepped pin 20 at its center. Further, a generally V-shaped guide slot 19*c* is formed through the bracket 19 and ahead of the annular projection 19*b*, the "V" of the guide slot 19c being open toward the platen 10**.

A switching gear 22 is rotatably mounted on the bracket 19 and seated on the annular projection 19b to remain in a horizontal position, a center opening 22a of the gear 22 being mated with the stepped pin 20. Specifically, the switching gear 22 is provided with a toothed portion 22b along its periphery except for a front part thereof, and a pair of lugs 22c in the front part of the periphery which face each other at a small spacing. An arcuate cam slot 22d is formed between the lugs 22c and the center opening 22a of the switching gear 22 such that its distance as measured from the center opening 22a sequentially increases toward the right and left ends. The previously stated motor gear 18b is held in constant mesh with the toothed portion 22b of the switching gear 22, whereby the gear 22 may be driven by the motor 18 in a rotational motion.

An angled beam-like switching lever 23 is provided with a projection 23a which extends downward from the tip of the switching lever 23 and is received in the cam slot 22d of the switching gear 22. The switching lever 23 is further provided with a hollow cylindrical portion 23b which extends upward from a base end of the switching lever 23, and a pivot portion 23c extending upward from the tip in alignment with the downward projection 23a. An engaging piece 23d extends from the tip of the switching lever 23 perpendicularly to the lever 23. The cylindrical portion 23b is coupled over the stepped pin 21 of the bracket 19 while, at stated earlier, the downward projection 23a is received in the cam slot 22d of the switching gear 22. In this configuration, the switching lever 23 is pivotally supported by the bracket 19 and extends in the lateral direction with the engaging piece 23 extending rearward.

The recording head 15 is coupled over the pivot portion 23c of the switching lever 23 at its base end. Specifically, the recording head 15 includes a head portion 24 which is provided with a pair of projections 24a, and a holder portion 25 which is provided with a pair of recesses 25a. The head portion 24 is connected to the holder portion 25 with its projections 24a individually mated with the recesses 25a. Two independent groups of recording electrodes, not shown, are individually provided on the right and left sides of the tip of the head portion 24, corresponding ones of the recording electrodes of the independent groups being interconnected by wiring patterns 26. While the head portion 24 and holder portion 25 are put together, a resilient member 27 and a flexible printed circuit board 28 are disposed therebetween. Connection patterns of the wiring patterns 26 and those of the printed circuit board 28 are accurately aligned with each other and, yet, surely electrically connected together by the action of the resilient member 27, which backs up the printed circuit board 28.

The holder portion 25 is formed through its base end with a through bore 25b in which the upright pivot portion 23c of the switching lever 23 is received, so that the recording head 15 is free to angularly move on the switching lever 23. A projection 25c extends downward from the underside of the holder portion 25 and is received in the V-shaped guide slot 19c of the bracket 19 by way of the space as defined between the lugs 22c of the switching gear 22. The width of the guide slot 19c is selected to be slightly greater than the diameter of the projection 25c so as to allow the projection 25c to be received in the guide slot 19c with some adequate clearance. A spring 29 is anchored at one end to the engaging piece 23d of the switching lever 23 and at the other end to an engaging piece 25d which extends rearward from the base end of the holder portion 25, whereby the recording head 15 is usually held in a neutral position as shown in FIG. 4.

Figure 4:
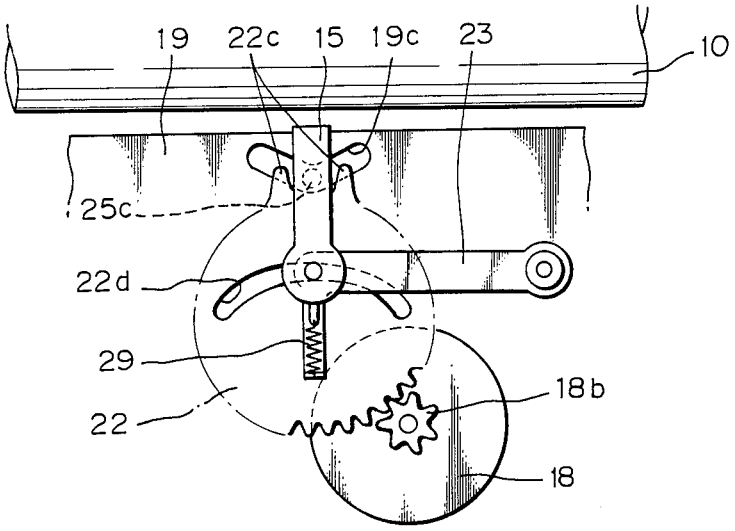
FIG. 4 is a view showing a recording head in a position for a forward printing stroke.
Figure 5:
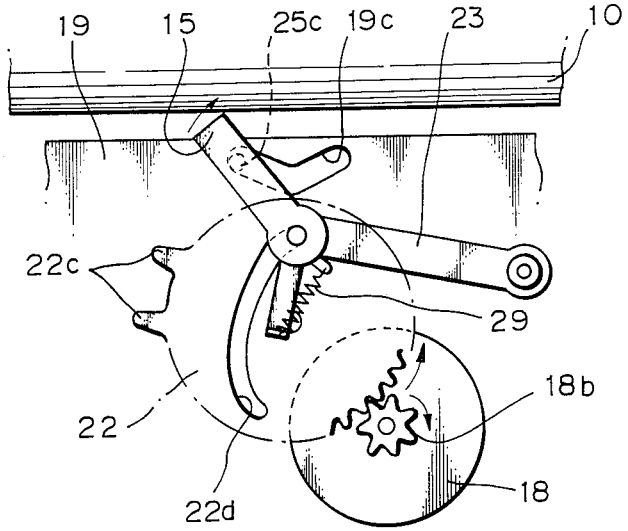
FIG. 5 is a view showing the recording head which is moved clear of a platen.

In operation, when the carrier 11 is to be moved for a forward printing stroke, i.e., usually from the left to the right along the platen 10, the motor 18 is energized to rotate the motor gear 18b clockwise as viewed in FIG. 4 and, thereby, the switching gear 22 counterclockwise. The switching gear 22 in turn angularly moves the switching lever 23 with its cam slot 22d in a direction for moving the recording head 15 toward the platen 10. At the same time, one of the lugs 22c of the switching gear 22 urges the projection 25c of the holder portion 25 so that the recording head 15 is rotated counterclockwise against the action of the spring 29. Even after released from the lug 22c, the projection 25c is guided by the guide slot 19c of the bracket 19 resulting that the recording head 15 is further rotated counterclockwise due to the rotation of the switching gear 22. Consequently, the recording electrode group mounted on the right-hand side of the recording head 15 is pressed against the platen 10. Since the projection 25c is received in the guide slot 19c with some clearance as previously stated, further rotation of the switching gear 22 causes the recording head 15 to further rotate agaisnt the action of the spring 29 and, as a result, the tip of the head 15 is pressed against the platen 10 by the spring 29, as shown in FIG. 5. Under this condition, the carrier 11 is driven for a forward printing stroke, which usually occurs from the left to the right, along the platen 10.

After the forward printing stroke, the motor 18 is driven in the reverse direction to rotate the motor gear 18b counterclockwise as viewed in FIG. 5 and, thereby,the switching gear 22 clockwise. Then, the switching lever 23 is rotate din the opposite direction, or returned, by the cam slot 22d so as to move the recording head 15 away from the platen 10. At the same time, the projection 25c of the holder portion 25 is guided by the guide slot 19c to rotate the recording head 15 clockwise until the projection 25c is brought to between the lugs 22c of the switching gear 22. This, coupled with the force of the spring 29, returns the recording head 15 to the neutral position as shown in FIG. 4. The neutral position of the recording head 15, i.e., that of the switching gear 22 is sensed by a sensor, not shown.

Figure 6:
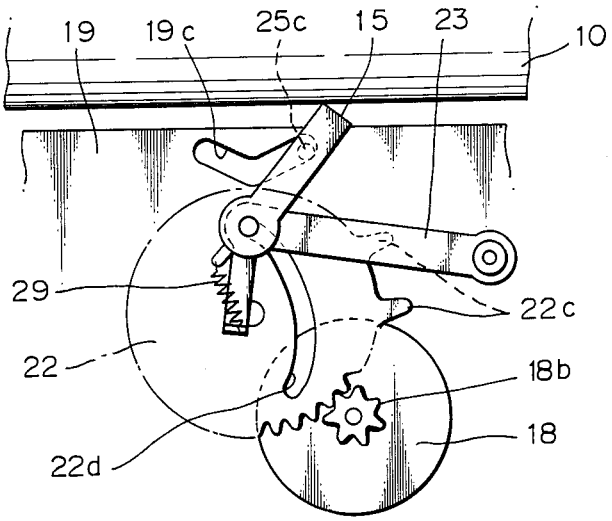
FIG. 6 is a view showing the recording head in another angular position which is adapted for a backward printing stroke.

When the carrier 11 is to be driven for a backward printing stroke along the platen 10, the reverse rotation of the motor 18 is continued to rotate the motor gear 18b counterclockwise and, thereby, the switching gear 22 clockwise. Then, the switching lever 23 is urged by the cam slot 22d again in the direction for moving the recording head 15 toward the platen 10. Simultaneously,the other lug 22c of the switching gear 22 uges the projection 25c to rotate the recording head 15 clockwise against the action of the spring 29. After released from the projection 22c, the projection 25c is guided by the guide slot 19c of the bracket 19 so that the recording head 15 is further rotated clockwise due to the rotation of the switching gear 22. Consequently, the recording head group mounted on the left-hand side of the recording head 15 is brought into pressing contact with the platen 10. Again, since the projection 25c is loosely fitted in the guide slot 19c, rotation of the switching gear 22 causes the recording head 15 to further rotate until the tip of the head 15 becomes pressed against the platen 10 by the spring 29, as shown in FIG. 6. Then, the carrier 11 is driven for a backward printing stroke, i.e., from the right to the left along the platen 10.

Upon completion of the backward printing stroke, the motor 18 is driven in the forward direction to rotate the motor gear **18*b* clockwise as viewed in FIG. 6 and, thereby, the switching gear 22 counterclockwise. Then, the switching lever 23 is returned by the cam slot 22*d* of the switching gear 22, moving the recording head 15 away from the platen 10. At the same time, the projection 25*c* of the holder portion 25 is guided by the guide slot 19*c* to rotate the recording head 15 counterclockwise, until the projection 25*c* is brought to between the lugs 22*c* of the switching gear 22. This, aided by the force of the spring 29, returns the recording head 15. The switching gear 22 is restored to the neutral position as shown in FIG. 4, in response to an output of the sensor which is representative of the return of the head 15**.

The above procedure is repeated thereafter. Specifically, the recording head 15 is rotated back and forth to change its angle of contact witht the platen 10 depending upon the direction of printing stroke of the carrier 11, whereby data are sequentially printed out in the paper 16 in both directions by the recording head 15.

While the embodiment has been shown and described in relation to a current-application transfer type printer which uses the ribbon 13, it should be noted that the mechanism of the present invention is similarly applicable to a current application type printer in which a recording head directly prints out information in a paper without the intermediary of a ribbon.

Also, the present invention is applicable not only to a printer shown and described but also to a typewriter and others.

In summary, it will be seen that the present invention provides a head rotating mechanism which allows a current-application type serial printer to print out data in both directions by using a recording head which is provided with two independent groups of recording electrodes, one for a forward stroke and the other for a backward stroke of a carrier.

Various modifications will become possible for those skilled in the art after receiving the teachings of the present disclosure without departing from the scope thereof.

We claim:

1. A head rotating mechanism for a printer in which a recording head provided with one recording electrode group at each of both sides of a tip of said recording head is mounted on a carrier and, while said carrier is sequentially driven for a forward and a backward stroke, a contact angel of said recording head with a platen is switched between the forward and backward strokes by rotating said recording head, said mechanism comprising:

a switching lever rotatably supporting said recording head;

a roatable switching gear having a cam portion for pivotally moving said switching lever in directions for moving said recording head toward and away from said platen, and an engaging portion for rotating said recording head based on the direction of rotation of said switching gear;

a bracket rotatably supporting said switching gear and switching lever and having a guide portion for guiding the rotation of said recording head;

a motor provided on said carrier together with said bracket for imparting rotation to said switching gear; and biasing means for usually maintaining said recording head in a predetermined position which is spaced apart from said platen, said recording head being caused to rotate against the force of said biasing means in response to rotation of said switching gear and being pressed toward said platen by the force of said biasing means.

2. A mechanism as claimed in claim 1, wherein said recording head comprises a head portion and a holder portion on which said head portion is mounted, said holder portion being provided with a through bore in which a pivot portion extending upward from said swithcing lever is received, whereby said recording head is rotatably supported on said switching lever.

3. A mechanism as claimed in claim 1, in which said biasing means comprises a spring which is anchored at one end to said recording head and at the other end to said switching lever to usually maintain said recording head in said predetermined position which is spaced apart from said platen, said recording head being caused to rotate against the force of said spring in response to rotation of said switching gear and being pressed against said platen by the force of said spring.

4. A mechanism as claimed in claim 1, wherein said cam portion comprises a cam slot which is formed through said switching gear, said switching lever being provided with a projection which is received in said cam slot for causing said switching lever to pivotally move said recording head toward and away from said platen.

5. A mechanism as claimed in claim 1, wherein said engaging portion of said swithcing gear comprises a pair of lugs which face each other, said recording head being provided with a projection which extends through between said lugs for causing said recording head to rotate.

6. A mechanism as claimed in claim 1, wherein said guide portion of said bracket comprises a generally V-shaped guide slot, said recording head being provide with a projection which is received in said guide slot for causing said recording head to rotate.

7. A mechanism as claimed in claim 1, in which said biasing means is anchored at one end to the recording head and at the other end to said switching lever.

8. A printer mechanism comprising:

a recording head having a tip with a first recording electrode group and a second recording electrode group;

a carrier on which said recording head is mounted, a platen and means for alternately driving said carrier in forward and a backward strokes along said platen;

a head rotating mechanism for changing the orientation of said head tip relative to the platen between said forward and backward strokes to thereby cause said first electrode group to be in a recording position adjacent said platen for said forward strokes but to cause said second electrode group to be in a recording position adjacent said platen for said backward strokes, said head rotating mechanism comprising:

a switching lever rotatably supporting said recording head;

a rotatable switching gear having a cam portion for pivotally moving said switching lever indirections for moving said recording head toward and away from said platen, and an engaging portion for rotating said recording head based on the direction of rotation of said switching gear;

a bracket rotatably supporting said switching gear and switching lever and having a guide portion for guiding the rotation of said recording head;

a motor provided on said carrier together with said bracket for imparting rotation to said switching gear; and biasing means for usually maintaining said recording head in a predetermined position which is spaced apart from said platen, said recording head being caused to rotate against the force of said biasing means in response to rotation of said switching gear and being pressed toward said platen by the force of said biasing means.

9. A printer mechanism as in claim 8 in which said biasing means comprises a spring which is anchored at one end to said recording head and at the other end to said switching lever to usually maintain said recording head in said predetermined position, said recording head being caused to rotate against the force of said spring in response to rotation of said switching gear and being pressed toward said platen by the force of said spring.

* * * * *